US010989413B2

(12) United States Patent
Hanson et al.

(10) Patent No.: US 10,989,413 B2
(45) Date of Patent: Apr. 27, 2021

(54) AXIAL RETENTION ASSEMBLY FOR COMBUSTOR COMPONENTS OF A GAS TURBINE ENGINE

(71) Applicant: General Electric Company, Schenectady, NY (US)

(72) Inventors: Stuart Craig Hanson, Anderson, SC (US); Thomas Alan Mogle, II, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 54 days.

(21) Appl. No.: 16/514,296

(22) Filed: Jul. 17, 2019

(65) Prior Publication Data

US 2021/0018179 A1 Jan. 21, 2021

(51) Int. Cl.
*F23R 3/00* (2006.01)
*F23R 3/60* (2006.01)

(52) U.S. Cl.
CPC ..... *F23R 3/60* (2013.01); *F05D 2240/35* (2013.01)

(58) Field of Classification Search
CPC ..... F23R 3/60; F23R 2900/00017; F23R 2900/00018; F23M 5/04; F05D 2240/35
See application file for complete search history.

(56) References Cited

U.S. PATENT DOCUMENTS 2,706,495 A 4/1955 Risley
3,859,787 A * 1/1975 Anderson ..... F02C 7/12 60/737
3,880,574 A * 4/1975 Irwin ..... F23R 3/007 431/353
3,990,231 A * 11/1976 Irwin ..... F23R 3/007 60/800

(Continued)

FOREIGN PATENT DOCUMENTS

DE 4340530 A1 6/1995
EP 2489938 A2 8/2012

(Continued)

OTHER PUBLICATIONS

European Search Report Corresponding to EP Application No. 181676875 dated Aug. 31, 2018.

(Continued)

*Primary Examiner* — Todd E Manahan
*Assistant Examiner* — Edwin Kang
(74) *Attorney, Agent, or Firm* — Dority & Manning, P.A.

(57) ABSTRACT

The present disclosure is directed to an axial retention assembly for combustor components of a gas turbine engine. The axial retention assembly may include a combustor having a liner and a casing, with the casing including a flange spaced apart from the liner along an axial centerline of the combustor. Furthermore, the axial retention assembly may include a mounting plate having a first end removably coupled to the flange and a second end positioned inward (Continued)

from the casing in a radial direction. Moreover, the axial retention assembly may include a clamp removably coupled to the liner. Additionally, the axial retention assembly may include a tie rod coupled to the second end of the mounting plate and the clamp to reduce relative movement between the liner and the casing along the axial centerline.

19 Claims, 4 Drawing Sheets

(56) References Cited

U.S. PATENT DOCUMENTS

| | | | | |
|---|---|---|---|---|
| 4,030,875 | A * | 6/1977 | Grondahl | F23R 3/007 60/753 |
| 4,039,115 | A | 8/1977 | Randolph et al. | |
| 4,202,539 | A | 5/1980 | Polastri et al. | |
| 4,337,932 | A | 7/1982 | Dennis et al. | |
| 4,358,143 | A | 11/1982 | Cullen | |
| 4,491,307 | A | 1/1985 | Ellefson | |
| 4,687,244 | A | 8/1987 | Cullen et al. | |
| 5,392,322 | A | 2/1995 | Whitling et al. | |
| 5,513,838 | A | 5/1996 | Van Rossum | |
| 5,600,690 | A | 2/1997 | Weems et al. | |
| 5,642,979 | A | 7/1997 | Cullen et al. | |
| 6,158,475 | A | 12/2000 | Clemmer | |
| 6,354,644 | B1 | 3/2002 | Zaguroli, Jr. et al. | |
| 6,371,468 | B1 | 4/2002 | Lessard et al. | |
| 6,371,685 | B1 | 4/2002 | Weems et al. | |
| 6,708,966 | B1 | 3/2004 | Troudt | |
| 6,716,018 | B2 | 4/2004 | Abrego et al. | |
| 6,733,058 | B1 | 5/2004 | Nakajima | |
| 7,225,837 | B1 | 6/2007 | Kane | |
| 8,104,290 | B2 | 1/2012 | Ellis et al. | |
| 8,448,444 | B2 | 5/2013 | Cihlar et al. | |
| 10,294,082 | B2 | 5/2019 | Merlau et al. | |
| 2001/0045695 | A1 | 11/2001 | Andronica | |
| 2011/0247193 | A1 | 10/2011 | Herbold | |
| 2011/0314829 | A1 | 12/2011 | Kuppusamy | |
| 2012/0036857 | A1 | 2/2012 | Bassani | |
| 2012/0096700 | A1 | 4/2012 | Patterson et al. | |
| 2012/0186269 | A1 | 7/2012 | Cihlar et al. | |
| 2014/0230246 | A1 | 8/2014 | McMahon et al. | |
| 2015/0071704 | A1 | 3/2015 | Senofonte et al. | |
| 2016/0363323 | A1 | 12/2016 | Mogle et al. | |
| 2016/0376926 | A1 | 12/2016 | Hanson et al. | |
| 2018/0038520 | A1 | 2/2018 | Pionetti | |
| 2018/0306446 | A1 | 10/2018 | Merlau et al. | |
| 2019/0010026 | A1 | 1/2019 | Merlau et al. | |

FOREIGN PATENT DOCUMENTS

| | | | |
|---|---|---|---|
| EP | 3106756 | A1 | 12/2016 |
| EP | 3293370 | A1 | 3/2018 |
| EP | 330040 | A1 | 6/2018 |
| FR | 3032511 | A1 | 8/2016 |
| JP | H08210642 | A | 8/1996 |
| WO | WO2014/126641 | | 8/2014 |

OTHER PUBLICATIONS

European Search Report Corresponding to EP Application No. 181781550 dated Dec. 11, 2018.

International Patent Application No. PCT/US2020/040484; International Search Report; dated Oct. 9, 2020; (3 pages).

* cited by examiner

AXIAL RETENTION ASSEMBLY FOR COMBUSTOR COMPONENTS OF A GAS TURBINE ENGINE

FIELD

The present disclosure generally relates to gas turbine engines. More particularly, the present disclosure relates to axial retention assemblies for reducing or preventing the axial movement of combustor components of a gas turbine engine.

BACKGROUND

A gas turbine engine generally includes a compressor, one or more combustors, a turbine, and an exhaust section. The compressor progressively increases the pressure of a working fluid (e.g., air) entering the gas turbine engine and supplies this compressed working fluid to the combustor(s). The compressed working fluid and a fuel (e.g., natural gas) mix and burn within the combustor(s) to generate combustion gases. The combustion gases, in turn, flow from each combustor into the turbine where they expand to produce work. For example, expansion of the combustion gases in the turbine section may rotate a rotor shaft connected to a generator to produce electricity. The combustion gases then exit the gas turbine via the exhaust section.

Each combustor typically includes a liner, a sleeve, and a combustor casing. More specifically, the liner defines a combustion chamber in which the mixture of compressed working fluid and fuel burns. The sleeve at least partially circumferentially surrounds the liner. In this respect, the sleeve and the liner define a flow passage through which the compressed air may flow before entering the combustion chamber. Furthermore, the combustor casing is coupled to the sleeve and defines a chamber positioned upstream of the combustion chamber. One or more fuel nozzles are positioned in the chamber defined by the combustor casing, with each fuel nozzle supplying the fuel to the combustion chamber.

When manufacturing a gas turbine engine, the various components of the combustor are generally pre-assembled or otherwise loosely coupled together before the combustor is installed into the engine. As such, the pre-assembled combustor must generally be transported within the factory to the final assembly location of the gas turbine engine. However, the liner and the casing of the pre-assembled combustor are typically not coupled together in a manner that prevents or minimizes the movement of such components along the axial centerline of the combustor. As such, the fuel lines of the combustor may be damaged during transportation, thereby necessitating expensive and time-consuming repairs.

BRIEF DESCRIPTION

Aspects and advantages of the technology will be set forth in part in the following description, or may be obvious from the description, or may be learned through practice of the technology.

In one aspect, the present disclosure is directed to an axial retention assembly for combustor components of a gas turbine engine. The axial retention assembly may include a combustor defining an axial centerline extending between a forward end of the combustor and an aft end of the combustor. The combustor may further define a radial direction extending orthogonally outward from the axial centerline.

The combustor may include a liner and a casing, with the casing including a flange spaced apart from the liner along the axial centerline. Furthermore, the axial retention assembly may include a mounting plate having a first end removably coupled to the flange and a second end positioned inward from the casing in the radial direction. Moreover, the axial retention assembly may include a clamp removably coupled to the liner. Additionally, the axial retention assembly may include a tie rod coupled to the second end of the mounting plate and the clamp to reduce relative movement between the liner and the casing along the axial centerline.

In another aspect, the present disclosure is directed to a gas turbine engine. The gas turbine engine may include a combustor defining an axial centerline extending between a forward end of the combustor and an aft end of the combustor. The combustor may further define a radial direction extending orthogonally outward from the axial centerline. The combustor may include a liner defining an aperture therethrough and a combustion chamber therein. Furthermore, the combustor may include a sleeve at least partially circumferentially positioned around the liner, with the sleeve and the liner defining a flow passage therebetween. In addition, the combustor may include a casing coupled to the sleeve, with the casing including a flange spaced apart from the liner along the axial centerline. The gas turbine engine may also include a plurality of axial retention tools. Each axial retention tool may include a mounting plate including a first end removably coupled to the flange and a second end positioned inward from the casing in the radial direction. Each axial retention tool may also include a clamp removably coupled to the liner. Moreover, each axial retention tool may include a tie rod positioned between the liner and the casing in the radial direction. As such, the tie rod may be coupled to the second end of the mounting plate and the clamp to reduce relative movement between the liner and the casing along the axial centerline.

These and other features, aspects and advantages of the present technology will become better understood with reference to the following description and appended claims. The accompanying drawings, which are incorporated in and constitute a part of this specification, illustrate embodiments of the technology and, together with the description, serve to explain the principles of the technology.

BRIEF DESCRIPTION OF THE DRAWINGS

A full and enabling disclosure of the present technology, including the best mode of practicing the various embodiments, is set forth in the specification, which makes reference to the appended figures, in which.

Figure 1:
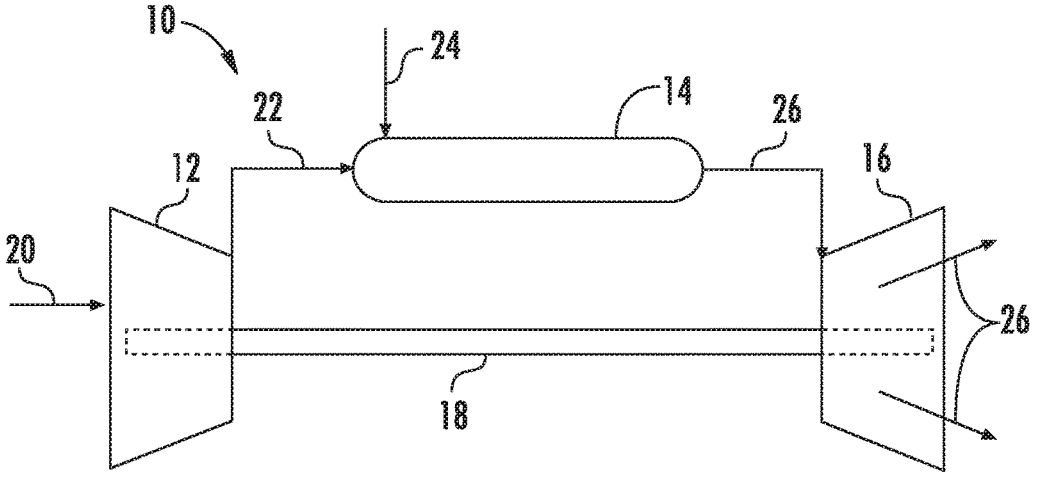
FIG. 1 is a schematic view of one embodiment of a gas turbine engine in accordance with aspects of the present disclosure.

Repeat use of reference characters in the present specification and drawings is intended to represent the same or analogous features or elements of the present technology.

DETAILED DESCRIPTION

Reference will now be made in detail to present embodiments of the technology, one or more examples of which are illustrated in the accompanying drawings. The detailed description uses numerical and letter designations to refer to features in the drawings. Like or similar designations in the drawings and description have been used to refer to like or similar parts of the technology. As used herein, the terms "first", "second", and "third" may be used interchangeably to distinguish one component from another and are not intended to signify location or importance of the individual components. The terms "upstream" and "downstream" refer to the relative direction with respect to fluid flow in a fluid pathway. For example, "upstream" refers to the direction from which the fluid flows, and "downstream" refers to the direction to which the fluid flows.

Each example is provided by way of explanation of the technology, not limitation of the technology. In fact, it will be apparent to those skilled in the art that modifications and variations can be made in the present technology without departing from the scope or spirit thereof. For instance, features illustrated or described as part of one embodiment may be used on another embodiment to yield a still further embodiment. Thus, it is intended that the present technology covers such modifications and variations as come within the scope of the appended claims and their equivalents.

In general, the present disclosure is directed to axial retention assemblies for combustor components of a gas turbine engine. Specifically, in several embodiments, the axial retention assembly may include one or more axial retention tools for reducing or preventing axial movement between a liner of a combustor and a combustor casing of during transportation and handling of the combustor (e.g., when installing the combustor in the gas turbine engine). In this respect, each axial retention tool may include a mounting plate having a first end removably coupled to a flange of the combustor casing. Each mounting plate may also include a second end positioned radially inward from the combustor casing. Furthermore, each axial retention tool may include a clamp removably coupled to the liner. For example, in one embodiment, the clamp(s) may reduce or prevent radial movement between the liner and a sleeve that at least partially surrounds the liner and is coupled to the combustor casing. Additionally, each axial retention tool may include a tie rod coupled to the second end of the corresponding mounting plate and the corresponding clamp. As such, the axial retention tool(s) may reduce or prevent relative movement between the liner and the combustor casing along the axial centerline of the combustor. Thus, the axial retention assembly permits transportation and handling of the combustor without resulting in damage to the fuel lines and/or other components of the combustor.

Although an industrial or land-based gas turbine is shown and described herein, the present technology as shown and described herein is not limited to a land-based and/or industrial gas turbine unless otherwise specified in the claims. For example, the technology as described herein may be used in any type of turbomachine including, but not limited to, aviation gas turbines (e.g., turbofans, etc.) and marine gas turbines.

Referring now to the drawings, FIG. 1 illustrates a schematic diagram of one embodiment of a gas turbine engine 10 in accordance with aspects of the present disclosure. As shown, the gas turbine engine 10 may generally include a compressor 12, one or more combustors 14 positioned downstream of the compressor 12, and a turbine 16 positioned downstream of the combustor(s) 14. Furthermore, the gas turbine engine 10 may include one or more shafts 18 coupling the compressor 12 and the turbine 16.

During operation of the gas turbine engine 10, a working fluid (e.g., as indicated by arrow 20), such as air, may flow into the compressor 12. The compressor 12 may, in turn, progressively compress the working fluid 20 to provide a pressurized working fluid (e.g., as indicated by arrow 22) to the combustor(s) 14. The pressurized working fluid 22 may mix with a fuel (e.g., as indicated by arrow 24) and burn within the combustor(s) 14 to produce combustion gases (e.g., as indicated by arrow 26). The combustion gases 26 may then flow from the combustor(s) 14 into the turbine 16, where rotor blades (not shown) extract kinetic and/or thermal energy from the combustion gases 26. This energy extraction may cause the shaft(s) 18 to rotate. The mechanical rotational energy of the shaft 18 may then be used to power the compressor 12 and/or generate electricity. Thereafter, the combustion gases 26 may be exhausted from the gas turbine engine 10.

Figure 2:
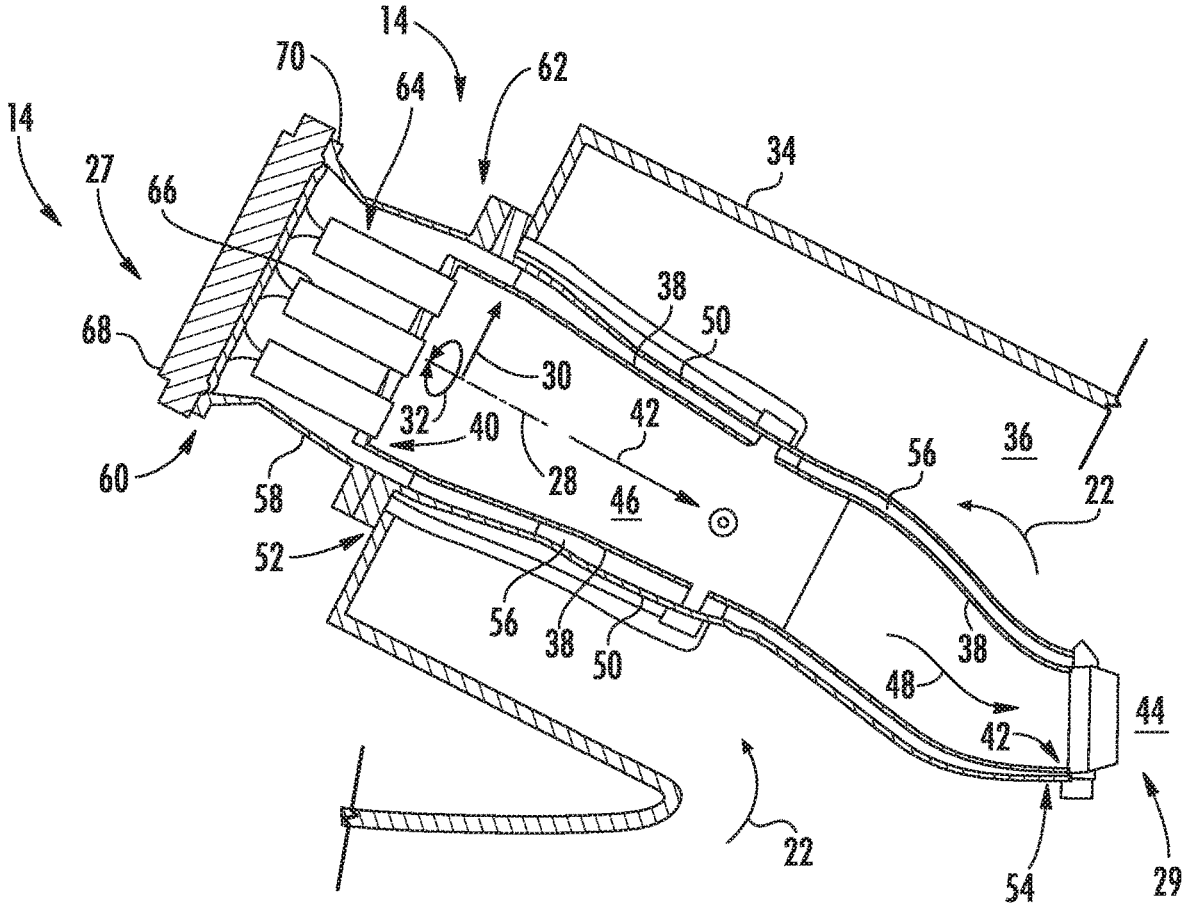
FIG. 2 is a cross-sectional side view of a combustor of a gas turbine engine in accordance with aspects of the present disclosure.

FIG. 2 illustrates one embodiment of a combustor 14 of a gas turbine engine in accordance with aspects of the present disclosure. As shown, the combustor 14 may define an axial centerline 28 extending from a forward end 27 of the combustor 14 and an aft end 29 of the combustor 14. Furthermore, the combustor 14 may define a radial direction 30 extending orthogonally outward from the axial centerline 28. Moreover, the combustor 14 may define circumferential direction 32 extending circumferentially around the axial centerline 28.

As shown, the combustor 14 may be installed in or otherwise at least partially received by a compressor discharge casing 34 of the gas turbine engine 10. The compressor discharge casing 34 may at least partially define a pressure plenum 36 at least partially surrounding various components of the combustor 14. Moreover, the pressure plenum 36 may be fluidly coupled to the compressor 12 (FIG. 1). As such, the pressure plenum 36 may receive the compressed working fluid 22 therefrom and provide the received compressed work fluid 22 to the combustor 14.

In several embodiments, the combustor 14 may include a combustion liner or duct 38. More specifically, the liner 38 may extend along the axial centerline 28 of the combustor 14 from a forward end 40 of the liner 38 to an aft end 42 of the liner 38. The aft end 42 may, in turn, be positioned adjacent to an inlet 44 of the turbine 16. In one embodiment, the forward end 40 may have a generally cylindrical cross-section, while the aft end 42 may have a generally rectangular cross-section. Furthermore, as shown, the liner 38 may at least partially define a combustion chamber or zone 46 in which a mixture of the pressurized work fluid 22 and the fuel 24 (FIG. 1) burns to form the combustion gases 26 (FIG. 1). Moreover, the liner 38 may also at least partially define a hot gas path 48 through the combustor 14 for directing the combustion gases 26 towards the turbine inlet 44. In some embodiments, the liner 38 may be formed as a single component (known as a unibody). However, in alternative embodiments, the liner 38 may have any other suitable configuration.

Moreover, the combustor 14 may include an outer sleeve 50 extending along the axial centerline 28 of the combustor 14 from a forward end 52 of the sleeve 50 to an aft end 54 of the sleeve 50. As shown, in several embodiments, the sleeve 50 may at partially circumferentially surround or enclose the liner 38. Furthermore, the sleeve 50 may be spaced apart from the liner 38 in the radial direction 30 to define a flow passage 56 therebetween. In this respect, the sleeve 50 may define a plurality of apertures (not shown) that fluidly couple the pressure plenum 36 and the flow passage 56. As such, the compressed working fluid 22 may flow from the pressure plenum 36 through the flow passage 56 for eventual delivery to the combustion chamber 46. In general, the sleeve 50 may be unrestrained relative to or decoupled from the liner 38 to permit relative movement therebetween along the axial centerline 28 (e.g., due to thermal gradients between the liner 38 and the sleeve 50). In some embodiments, the sleeve 50 may be formed as a single component (known as a unibody). However, in alternative embodiments, the sleeve 50 may have any other suitable configuration.

Additionally, the combustor 14 may include a combustor casing 58 coupled to the forward end 52 of the sleeve 50. Specifically, in several embodiments, the combustor casing 58 may extend along the axial centerline 28 of the combustor 14 from a forward end 60 of the combustor casing 58 to an aft end 62 of the combustor casing 58. Furthermore, as shown, the combustor casing 58 may define a head end volume 64 of the combustor 14 therein. The head end volume 64 may, in turn, be positioned upstream of the combustion chamber 46 along the axial centerline 28. In this respect, one or more fuel nozzles 66 may be positioned within the head end volume 64 to supply the fuel 24 to the combustion chamber 46. Furthermore, an end cover 68 may be coupled to the forward end 60 of the combustor casing 58. For example, in one embodiment, the end cover 68 may be coupled to a mounting flange 70 of the combustor casing 58 (e.g., via bolts or other suitable fasteners). However, in alternative embodiments, the combustor casing 58 may have any other suitable configuration.

The configuration of the gas turbine engine 10 described above and shown in FIGS. 1 and 2 is provided only to place the present subject matter in an exemplary field of use. Thus, it should be appreciated that the present subject matter may be readily adaptable to any manner of gas turbine engine configuration.

Figure 3:
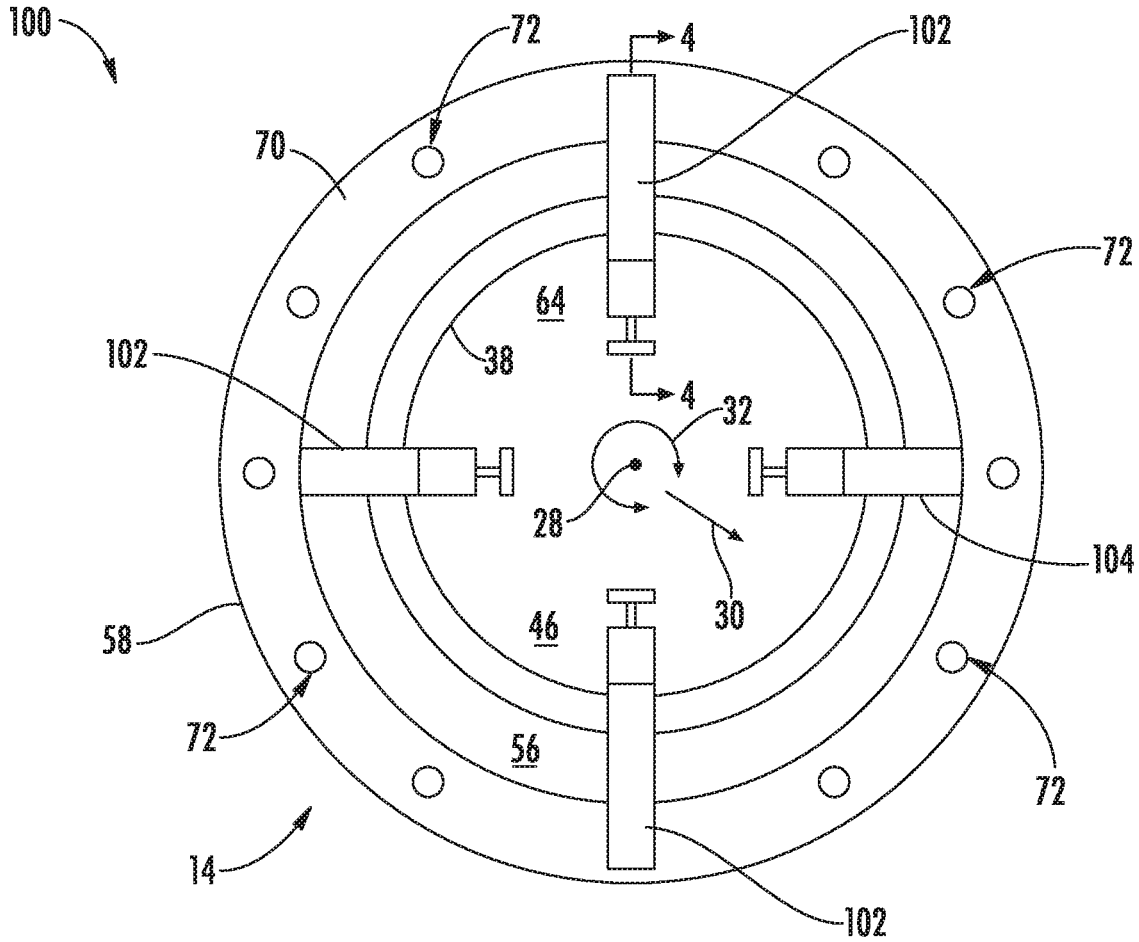
FIG. 3 is a top view of one embodiment of an axial retention assembly for combustor components of a gas turbine engine in accordance with aspects of the present disclosure, particularly illustrating a plurality of axial retention tools coupling a liner of the combustor and a casing of the combustor.

Referring now to FIG. 3, a schematic view of one embodiment of an axial retention assembly 100 for combustor components of a gas turbine engine is illustrated in accordance with aspects of the present disclosure. In general, the axial retention assembly 100 will be described herein with reference to the gas turbine engine 10 described above with reference to FIGS. 1 and 2. However, the disclosed system 100 may generally be used with gas turbine engines having any other suitable engine configuration.

As shown, the mounting flange 70 of the combustor casing 58 may define a plurality of mounting apertures 72. In general, each mounting aperture 72 may receive a suitable fastener (e.g., a bolt) for coupling the end cover 68 (FIG. 2) to the forward end 60 of the combustor casing 58. In the embodiment shown in FIG. 3, the mounting flange 70 defines twelve mounting apertures 72. Furthermore, the mounting apertures 70 may be spaced apart from each other along the circumferential direction 32 (e.g., every thirty degrees). However, in alternative embodiments, the mounting flange 70 may define any other suitable number of mounting apertures 72. Moreover, the mounting apertures 72 may be positioned on the mounting flange 70 in any other suitable manner.

In several embodiments, the axial retention assembly 100 may include one or more axial retention tools 102. In general, when the combustor 14 is installed in the compressor discharge casing 34 (FIG. 2) of the gas turbine engine 10, the end cover 68 and the fuel nozzles 66 (FIG. 2) may not be installed or otherwise present within or the combustor 14. In this respect, the axial retention tool(s) 102 may be positioned within the head end volume 64, the combustion chamber 46, and flow passage 56 of the combustor 14. Specifically, as will be described in greater detail below, each axial retention tool 102 may be coupled to the mounting flange 70 of the combustor casing 58 and the forward end 40 of the liner 38 such that tool(s) 102 collectively reduce or prevent relative movement between the sleeve/combustor casing 50/58 and the liner 38 along the axial centerline 28 during such installation and associated transportation/handling of the combustor 14. For example, in the illustrated embodiment, the axial retention assembly 100 includes two axial retention tools 102, with such tools 102 being spaced apart from each other in the circumferential direction 32 by 180 degrees. However, in alternative embodiments, the axial retention assembly 100 may include any other suitable number of axial retention tools 102. For example, in one alternative embodiment, the axial retention assembly 100 may include four axial retention tools 102, with such tools 102 being spaced apart from each other in the circumferential direction 32 by ninety degrees.

Moreover, in several embodiments, the axial retention assembly 100 may include one or more clamps 104. In general, each clamp 104 may be coupled between the forward end 40 of the liner 38 and the forward end 52 of the sleeve 50 to reduce or prevent movement between the sleeve/combustor casing 50/58 and the liner 38 in the radial direction 30 during installation, transportation, and handling of the combustor 14. As such, in one embodiment, the clamp(s) 104 may be wedge clamps that reduce/prevent such radial movement by pushing the liner 38 radially inward and the sleeve 50 radially outward. Furthermore, in the illustrated embodiment, the axial retention assembly 100 includes two clamps 104, with such clamps 104 being spaced apart from each other by 180 degrees and spaced apart from the axial retention tools 102 by ninety degrees. However, in alternative embodiments, the axial retention assembly 100 may include any other suitable number of clamps 104 (including zero clamps 104) and/or the clamps 104 may have any other suitable configuration or positioning. In addition, as will be described in greater detail below, each axial retention tool 102 may include a clamp coupled between the liner 38 and the sleeve 50 to further prevent relative radial movement between the sleeve/combustor casing 50/58 and the liner 38.

Figure 4:
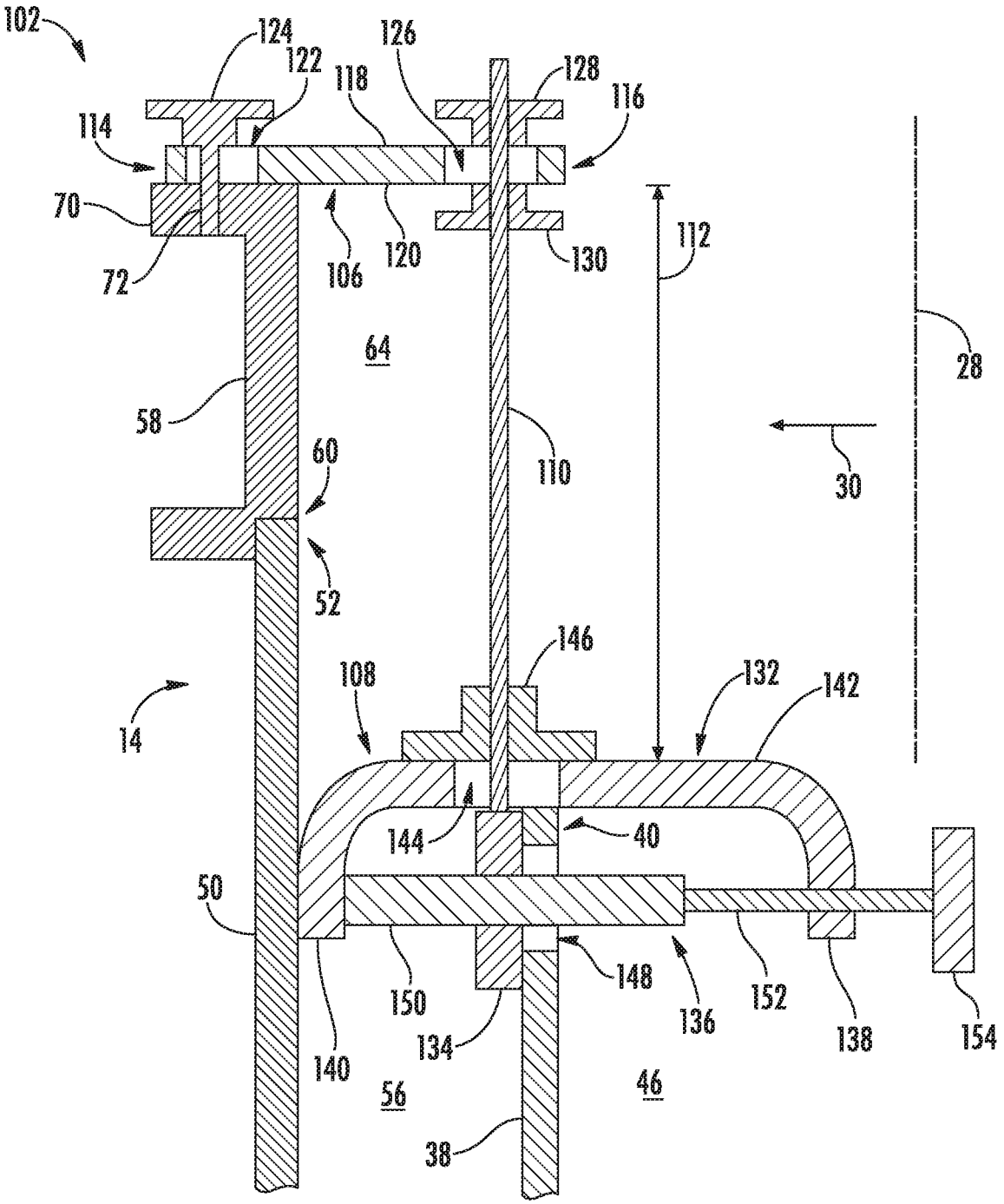
FIG. 4 is a cross-sectional view of one of the axial retention tools shown in FIG. 3 taken generally about line 4-4.
Figure 5:
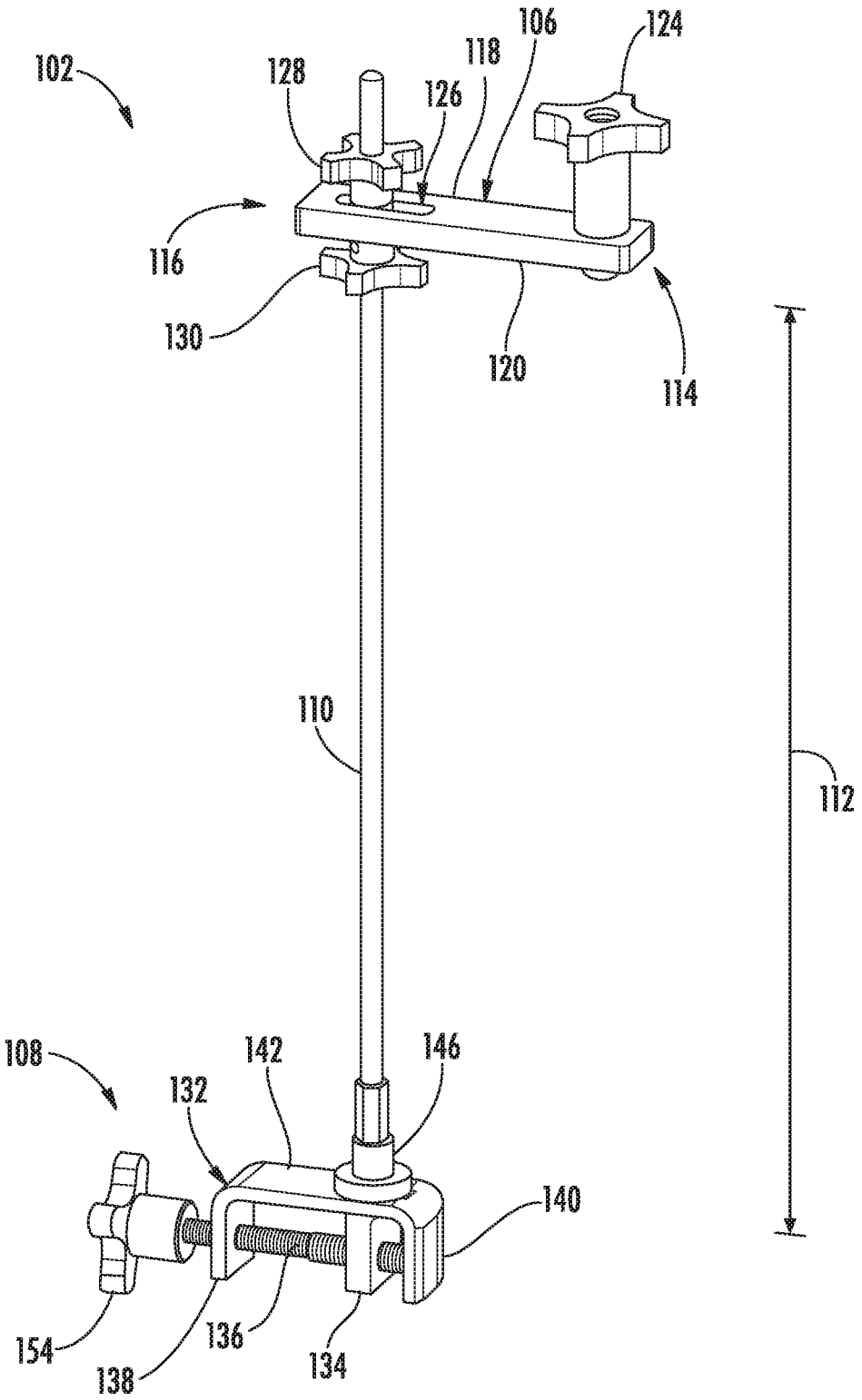
FIG. 5 is a perspective view of the axial retention tool shown in FIG. 4.

FIGS. 4 and 5 illustrate differing views of one embodiment of an axial retention tool 102 in accordance with aspects of the present disclosure. Specifically, FIG. 4 illustrates a cross-sectional view of the axial retention tool 102 installed within the combustor 14 and taken generally about Line 4-4 in FIG. 3. Moreover, FIG. 5 illustrates a perspective view of the axial retention tool 102 removed from the combustor 14.

In several embodiments, the axial retention tool 102 may generally include a mounting plate 106, a clamp 108, and a tie rod 110. More specifically, when the axial retention tool 102 is installed within the combustor 14, the mounting plate 106 may be removably coupled to the combustor casing 58. Furthermore, the clamp 108 may be removably coupled to the forward and 40 of the liner 38. In this respect, the tie rod 110 may be coupled to and extend between the mounting plate 106 and the clamp 108. As such, the tie rod 110 may maintain a selected distance (e.g., as indicated by arrow 112)

between the mounting plate 106 and the clamp 108 to reduce or prevent reduce or prevent relative movement between the sleeve/combustor casing 50/58 and the liner 38 along the axial centerline 28.

As shown, the mounting plate 106 may extend between a first end 114 and a second end 116 in the radial direction 30 and between a first side 118 and a second side 120 along the axial centerline 28. Specifically, in several embodiments, the first end 114 of the mounting plate 106 may be removably coupled to the flange 70 of the combustor casing 58. In this respect, the first end 114 may define an aperture 122 that is at least partially radially and circumferentially aligned with one of the mounting apertures 72 defined by the flange 70. As such, a fastener, such as the illustrated bolt 124, may be partially received within the apertures 72, 122 to removably couple the mounting plate 106 to the combustor casing 58. Furthermore, the second end 116 of the mounting plate 106 may be positioned radially inward of (i.e., closer to the axial centerline 28 of the combustor 14 than) the combustor casing 58. Moreover, in one embodiment, the aperture 122 defined by the first end 114 may correspond to an elongated slot. In such an embodiment, the elongated slot may permit for adjustment of the radial position of the second end 116 of the mounting plate 106 relative to the combustor casing 58, thereby allowing the axial retention tool 102 to be installed in differing combustor configurations.

Additionally, the second end 116 of the mounting plate 106 may be coupled to the tie rod 110. In this respect, the second end 116 may define an aperture 126 that receives the tie rod 110. For example, in one embodiment, the aperture 126 may correspond to an elongated slot. In such an embodiment, the elongated slot may permit for adjustment of the radial position of the tie rod 110 relative to the second end 116 of the mounting plate 106, thereby allowing the axial retention tool 102 to be installed in differing combustor configurations. Furthermore, in several embodiments, the tie rod 110 may be threaded. In such embodiments, one or more suitable fasteners 128, 130 may couple the tie rod 110 to the mounting plate 106, thereby setting the distance 112 between the mounting plate 106 and the clamp 108. In one embodiment, the distance 112 may be adjustable to accommodate different combustor configurations. For example, in such an embodiment, a first fastener 128 may threadingly engage the tie rod 110 on one side of the mounting plate 106 (e.g., adjacent to the first side 118 of the mounting plate 106). Moreover, a second fastener 130 may threadingly engage the tie rod 110 on the other side of the mounting plate 106 (e.g., adjacent to the second side 120 of the mounting plate 106). As such, the fasteners 128, 130 may be rotated to move the tie rod 110 relative to the mounting plate 106 along the axial centerline 28, thereby permitting adjustment of the distance 112. However, in alternative embodiments, the mounting plate 106 may have any other suitable configuration.

As indicated above, the axial retention tool 102 may include the clamp 108 coupled to the forward end 40 of the liner 38. In general, the clamp 108 may reduce or prevent relative radial movement between the sleeve/combustor casing 50/58 and the liner 38. As such, in several embodiments, the clamp 108 may reduce/prevent such radial movement by pushing the liner 38 radially inward and the sleeve 50 radially outward. That is, the clamp 108 may be a wedge clamp. More specifically, the clamp 108 may include a clamp frame 132, a clamp plate 134, and a clamp rod 136. In this respect, the clamp rod 136 may push the clamp frame 132 into contact with the sleeve 50 and the clamp plate 134 into contact with the liner 38. As such, the clamp frame 132 may apply a radially outward force (i.e., a force directed away from the axial centerline 28) to the sleeve 50, while the clamp plate 134 may apply a radially inward force (i.e., a force directed toward the axial centerline 28) to the liner 38. Such opposing forces may, in turn, may reduce or prevent relative radial movement between the sleeve/combustor casing 50/58 and the liner 38. Furthermore, such opposing forces may also assist in coupling the clamp 108 to the forward end 40 of the liner 38.

In several embodiments, the clamp frame 132 may include a first wall 138, a second wall 140, and a third wall 142. More specifically, the first and second walls 138, 140 may generally be oriented parallel to the liner/sleeve/combustor casing 38/50/58. The third wall 142 may, in turn, extend in the radial direction 30 from the first wall 138 to the second wall 140. As such, in one embodiment, the clamp frame 132 may generally have a U-shape. Furthermore, the first wall 138 may be positioned within the combustion chamber 46 of the combustor 14, while the second wall 140 may be positioned within the flow passage 56 of the combustor 14. In this respect, the third wall 142 may be positioned within the head end volume 64 of the combustor 14. In addition, the third wall 142 may be positioned on and/or in contact with the forwardmost surface or edge of the liner 38. However, in alternative embodiments, the clamp frame 132 may have any other suitable configuration.

In several embodiments, as indicated above, the clamp 108 may include the clamp plate 134. More specifically, the clamp plate 134 may be positioned between the first and second walls 138, 140 of the clamp frame 132. In this respect, the clamp plate 134 may be movable the in the radial direction 30 between the first and second walls 138, 140 of the clamp frame 132. As will be described in greater detail below, the clamp plate 134 may threadingly engage the clamp rod 136 such that rotation of the clamp rod 136 moves the clamp plate 134 between the first and second walls 138, 140. In addition, the clamp plate 134 may correspond to a block or plate suitable for exerting a radially inner force on the liner 30. However, in alternative embodiments, the clamp plate 134 may have any other suitable configuration.

Additionally, in several embodiments, the clamp plate 134 may be coupled to the tie rod 110 such that the tie rod 110 is positioned between the sleeve/combustor casing 50/58 and the liner 38 in the radial direction 30. Specifically, in one embodiment, the third wall 142 of the clamp frame 132 may define an elongated slot 144 extending therethrough. As such, the tie rod 110 may extend from the mounting plate 106 and through the elongated slot 144 to couple to the clamp plate 134. In this respect, the elongated slot 144 may permit the clamp plate 134 to move in the radial direction 30 between the first and second walls 138, 140 of the clamp frame 132 when the clamp plate 132 is coupled to the tie rod 110. Moreover, in one embodiment, a grommet 146 may be positioned between the clamp frame 132 and the mounting plate 106 such that the grommet 146 is in contact with the third wall 142 of clamp frame 132. However, in alternative embodiments, the tie rod 110 may be coupled to any other suitable component or portion of the clamp 108.

As indicated above, the clamp rod 136 may generally push the clamp frame 132 into contact with the sleeve 50 and the clamp plate 134 into contact with the liner 38. More specifically, in several embodiments, the clamp rod 136 may extend through and threadingly engage the first wall 138 of the clamp frame 132. Furthermore, clamp rod 36 may also extend through an aperture 148 defined by the forward end 40 of the liner 38 and the clamp plate 134. In this respect, rotation of the clamp rod 136 relative to the clamp frame 132 may cause the clamp rod 136 to translate or otherwise move in the radial direction 30 relative to the clamp frame 132. The radial movement of the clamp rod 136 may, in turn, move the clamp plate 134 in the radial direction 30 between the first and second walls 138, 140 of the clamp frame 132. Moreover, in one embodiment, the threaded rod 136 may include a first portion 150 positioned between the first and second walls 138, 140 of the clamp frame 132 and a second portion 152 that extends through the first wall 138. In such an embodiment, the first portion 150 may have a greater diameter than the second portion 152 to prevent the clamp rod 136 from disengaging the first wall 138 of the clamp frame 132. Additionally, in one embodiment, a handle 154 may be coupled to the radially inner end of the threaded rod 136 to permit easy rotation of the clamp rod 136.

In general, the axial retention tool 102 may be installed within the combustor 14 to reduce or prevent relative movement between the liner 38 and the sleeve/combustion casing 50/58 along the axial centerline 28 and/or in the radial direction 30. More specifically, the first end 114 of the mounting plate 106 may be removably coupled (e.g., via the fastener(s) 124) to the flange 70 of the combustor casing 58. After such coupling, the second end 116 of the mounting plate 106, the clamp 108, and the tie rod 110 may be positioned radially inward from the combustor casing 58. The first and second fasteners 128, 130 may be rotated relative to the tie rod 110 to adjust the distance 112 between the mounting plate 106 and the clamp 108. Such distance 112 may be adjusted to align the clamp rod 136 with the aperture 148 defined by the liner 38 along the axial centerline 28. Thereafter, the clamp rod 136 may be rotated relative to the clamp frame 132, thereby causing the clamp rod 136 extend through the aperture 148 and engage clamp plate 134. Continued rotation of the clamp rod 136 may cause the second wall 140 of the clamp frame 132 to contact with the sleeve 50 and the clamp plate 134 into contact with the liner 38. Such contact may, in turn, cause the second wall 140 to exert a radially outward force on the sleeve 50 and the clamp plate 134 to exert a radially inner force on the liner 38. However, in alternative embodiments, the axial retention tool 102 may be installed within the combustor 14 in any other suitable manner. For example, the clamp 108 may be coupled between the liner 38 and the sleeve 50 before the mounting plate 106 is removably coupled to the combustor casing 58.

As indicated above, the axial retention assembly 100 may include a plurality of axial retention tools 102. In such embodiments, each axial retention tool 102 in the same manner as described above. Additionally, in some embodiments, the axial retention assembly 100 may also include one or more clamps 104. In several embodiments, the clamps 104 may be configured the same as or similar to the clamp(s) 108 of the axial retention tools(s) 102. In such embodiments, the clamps 104 may be installed between the liner 38 and the sleeve 50 in the same manner as the clamp(s) 108.

This written description uses examples to disclose the technology, including the best mode, and also to enable any person skilled in the art to practice the technology, including making and using any devices or systems and performing any incorporated methods. The patentable scope of the technology is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. An axial retention assembly for combustor components of a gas turbine engine, the axial retention assembly comprising:

a combustor defining an axial centerline extending between a forward end of the combustor and an aft end of the combustor, the combustor further defining a radial direction extending orthogonally outward from the axial centerline, the combustor including a liner and a casing, the casing including a flange spaced apart from the liner along the axial centerline;

a mounting plate including a first end removably coupled to the flange and a second end positioned inward from the casing in the radial direction;

a clamp removably coupled to the liner, the clamp comprising a clamp frame including a first wall and a second wall spaced apart from the first wall in the radial direction, a clamp plate positioned between the first wall and the second wall, and a clamp rod threadingly engaging the first wall and the clamp plate such that rotation of the clamp rod relative to the first wall moves the clamp plate between the first wall and the second wall in the radial direction; and a tie rod coupled to the second end of the mounting plate and the clamp to reduce relative movement between the liner and the casing along the axial centerline.

2. The axial retention assembly of claim 1, wherein the tie rod is positioned between the liner and the casing in the radial direction.

3. The axial retention assembly of claim 1, wherein the tie rod is adjustably coupled to the second end of the mounting plate.

4. The axial retention assembly of claim 3, further comprising:

a first fastener threadingly engaging the tie rod on one of a first side or a second side of the mounting plate;

a second fastener threadingly engaging the tie rod on the other of the first side or the second side of the mounting plate, wherein movement of the first fastener and the second fastener relative to the tie rod adjusts a distance between the mounting plate and the clamp along the axial centerline.

5. The axial retention assembly of claim 1, wherein the second end of the mounting plate defines an elongated slot, the tie rod extending through the elongated slot.

6. The axial retention assembly of claim 1, wherein:

the combustor further comprises a sleeve coupled to the casing and at least partially circumferentially positioned around the liner, the liner and the sleeve defining a flow passage therebetween;

the liner defines an aperture therethrough and a combustion chamber therein;

the first wall of the clamp frame is positioned within the combustion chamber;

the second wall of the clamp frame is positioned within the flow passage; and the clamp rod extends through the aperture defined by the liner.

7. The axial retention assembly of claim 1, wherein the tie rod is coupled to the clamp plate.

8. The axial retention assembly of claim 7, wherein the clamp frame further includes a third wall extending from the first wall to the second wall in the radial direction, the third wall defining an elongated slot through which the tie rod extends.

9. The axial retention assembly of claim 1, wherein the clamp rod comprises a first portion and a second portion, the first portion having a different diameter than a second portion.

10. A gas turbine engine, comprising:

a combustor defining an axial centerline extending between a forward end of the combustor and an aft end of the combustor, the combustor further defining a radial direction extending orthogonally outward from the axial centerline, the combustor comprising:

a liner defining an aperture therethrough and a combustion chamber therein;

a sleeve at least partially circumferentially positioned around the liner, the sleeve and the liner defining a flow passage therebetween; and a casing coupled to the sleeve, the casing including a flange spaced apart from the liner along the axial centerline; and a plurality of axial retention tools, each axial retention tool comprising:

a mounting plate including a first end removably coupled to the flange and a second end positioned inward from the casing in the radial direction;

a clamp removably coupled to the liner; and a tie rod positioned between the liner and the casing in the radial direction, the tie rod coupled to the second end of the mounting plate and the clamp to reduce relative movement between the liner and the casing along the axial centerline.

11. The gas turbine engine of claim 10, wherein each of the plurality of axial retention tools are circumferentially spaced apart from each other around the combustor.

12. The gas turbine engine of claim 10, wherein the tie rod is positioned between the liner and the casing in the radial direction.

13. The gas turbine engine of claim 10, wherein the tie rod is adjustably coupled to the second end of the mounting plate.

14. The gas turbine engine of claim 13, wherein each axial retention tool further comprises:

a first fastener threadingly engaging the tie rod on one of a first side or a second side of the mounting plate;

a second fastener threadingly engaging the tie rod on the other of the first side or the second side of the mounting plate, wherein movement of the first fastener and the second fastener relative to the tie rod adjusts a distance between the mounting plate and the clamp along the axial centerline.

15. The gas turbine engine of claim 10, wherein the second end of the mounting plate defines an elongated slot, the tie rod extending through the elongated slot.

16. The gas turbine engine of claim 10, wherein the clamp comprises:

a clamp frame including a first wall and a second wall spaced apart from the first wall in the radial direction;

a clamp plate positioned between the first wall and the second wall; and a clamp rod threadingly engaging the first wall and the clamp plate, wherein rotation of the clamp rod relative to the first wall moves the clamp plate between the first wall and the second wall in the radial direction.

17. The gas turbine engine of claim 16, wherein:

the first wall of the clamp frame is positioned within the combustion chamber;

the second wall of the clamp frame is positioned within the flow passage; and the clamp rod extends through the aperture defined by the liner.

18. The axial retention assembly of claim 16, wherein the tie rod is coupled to the clamp plate.

19. The gas turbine engine of claim 18, wherein the clamp frame further includes a third wall extending from the first wall to the second wall in the radial direction, the third wall defining an elongated slot through which the tie rod extends.

* * * * *